US011569606B2

(12) United States Patent
Spinella et al.

(10) Patent No.: US 11,569,606 B2
(45) Date of Patent: Jan. 31, 2023

(54) ELECTRICAL PLUG

(71) Applicant: EGGTRONIC ENGINEERING S.P.A., Modena (IT)

(72) Inventors: Igor Spinella, Modena (IT); Camilla Bettinelli, Modena (IT); Fabrizio Caramaschi, Carpi (IT)

(73) Assignee: EGGTRONIC ENGINEERING S.P.A., Modena (IT)

( * ) Notice: Subject to any disclaimer, the term of this patent is extended or adjusted under 35 U.S.C. 154(b) by 0 days.

(21) Appl. No.: 17/369,093

(22) Filed: Jul. 7, 2021

(65) Prior Publication Data

US 2022/0013947 A1 Jan. 13, 2022

(30) Foreign Application Priority Data

Jul. 13, 2020 (IT) ..... 102020000016942

(51) Int. Cl.
*H01R 13/44* (2006.01)
*H01R 103/00* (2006.01)

(52) U.S. Cl.
CPC ..... *H01R 13/44* (2013.01); *H01R 2103/00* (2013.01)

(58) Field of Classification Search
CPC .. H01R 13/44; H01R 2103/00; H01R 13/055; H01R 24/66
See application file for complete search history.

(56) References Cited

U.S. PATENT DOCUMENTS

| | | | | |
|---|---|---|---|---|
| 4,010,999 | A * | 3/1977 | Hoffman | H01R 13/501 439/467 |
| 5,611,701 | A | 3/1997 | Hahn | |
| 6,312,271 | B1 * | 11/2001 | Tseng | H01R 13/44 439/131 |
| 9,331,441 | B2 | 5/2016 | Roy et al. | |
| 9,793,649 | B1 * | 10/2017 | Lin | H01R 13/055 |
| 2010/0291779 | A1 * | 11/2010 | Hopwood | H01R 24/28 439/131 |
| 2013/0316553 | A1 * | 11/2013 | Lee | H01R 35/04 439/131 |
| 2016/0134071 | A1 * | 5/2016 | Toh | H01R 35/04 439/13 |
| 2019/0207349 | A1 * | 7/2019 | Yuan | H01R 13/631 |
| 2020/0106214 | A1 * | 4/2020 | Du | H01R 24/30 |
| 2022/0208286 | A1 * | 6/2022 | Ameen Beshari | G11C 16/26 |

* cited by examiner

*Primary Examiner* — Truc T Nguyen
(74) *Attorney, Agent, or Firm* — Browdy and Neimark, PLLC

(57) ABSTRACT

An electrical plug includes a support body, a pair of electrical contacts of elongated shape having respective longitudinal axes arranged coplanar on a common lying plane, and connecting members adapted to allow a mutual movement between said electrical contacts and the support body. The connecting members include a first rocker hinged to the support body according to a first hinging axis perpendicular to the lying plane, and a second rocker hinged to the support body according to a second hinging axis parallel and spaced with respect to the first hinging axis, each electrical contact being fixed overhanging a respective of the first and second rockers.

7 Claims, 8 Drawing Sheets

ELECTRICAL PLUG

TECHNICAL FIELD

The present invention relates to an electrical plug and, in particular but not exclusively, to an electrical plug adapted to be associated with a power supply for electrical/electronic devices, such as for example laptop computers, tablet computers, smartphones and much more.

BACKGROUND

It is known that many electrical/electronic devices of the type mentioned above are powered and/or recharged by means of electrical power supplies which are capable of converting the alternating voltage coming from the electrical distribution network into a suitable direct voltage.

In order to connect to the electrical distribution network, these power supplies are commonly provided with an electrical plug, which normally comprises at least two electrical contacts which are suitable for being inserted in the slots of a corresponding electrical socket.

Depending on the type of electrical socket adopted in the various countries of the world, the electrical contacts of the plug can have different shapes.

For example, in order to be able to be coupled with type C sockets, used in most European countries, the plug must have cylindrical electrical contacts, while in order to be able to be coupled with type A sockets, used in the United States and other countries, the electrical contacts of the plugs must have a flat shape.

Regardless of said considerations, electrical plugs in which, generally for reasons of general dimension and/or aesthetics, the electrical contacts are not rigidly fixed to the body of the plug but are connected to the latter through connection means which allow the movement between an "open" configuration and a "closed" configuration are also known.

In the open configuration, the electrical contacts protrude overhanging from the body of the plug to be able to be coupled to the corresponding socket, while in the closed configuration, the electrical contacts are hidden inside or any way are close to the body of the plug.

For example, retractable electrical plugs in which the electric contacts can be made to slide inside the body of the plug along a direction parallel to their axis are known.

In this case, the overall dimension of the plug remain however quite high, since the body of the same must be sufficiently large to be able to contain the electrical contacts in the closed configuration.

Other types of electrical plugs provide that the electrical contacts can be reclined on the body of the plug by means of a rigid movement of both electrical contacts around a common axis of rotation.

Even in this case, however, the displacement of the electrical contacts in the closed configuration does not lead to an effective reduction of the overall dimensions but a mere redistribution of the volumes.

DISCLOSURE OF THE INVENTION

In the light of the foregoing, an object of the present invention is to make available an electrical plug which can overcome or at least mitigate the drawbacks of the prior art.

Another object is to achieve this objective in the context of a simple, rational and relatively low-cost solution.

These and other objects are reached thanks to the characteristics of the invention as set forth in the independent claims. The dependent claims outline preferred and/or particularly advantageous aspects of the invention but not essential for the implementation thereof.

In particular, an embodiment of the present invention makes available an electrical plug comprising:

- a support body,
- a pair of elongated electrical contacts having respective longitudinal axes arranged coplanar on a common lying plane, and
- connecting members adapted to allow a mutual movement between said electrical contacts and the support body, wherein said connecting members comprise:

- a first rocker hinged to the support body according to a first hinging axis perpendicular to the lying plane, and
- a second rocker hinged to the support body according to a second hinging axis parallel and spaced with respect to the first hinging axis, each electrical contact being fixed overhanging a respective of said first and second rockers.

Thanks to this solution, the electrical contacts can advantageously be shifted from an open configuration, in which the electrical contacts protrude overhanging with respect to the support body with their respective longitudinal axes parallel to each other, and a closed configuration, in which the electrical contacts are substantially reclined on each other.

For example, the rotation of each electrical contact from the open configuration to the closed configuration can be equal to 90° (or almost).

By reclining on each other, the mutual distance between the electrical contacts progressively decreases in the passage from the open configuration to the closed configuration, thus obtaining not only a redistribution of the overall dimensions but also a real reduction of the same.

In practice, the electrical contacts in closed configuration prove to form a more compact group and therefore less bulky than the one they form when they are in open configuration.

According to an aspect of the invention, the connecting means can further comprise:

- a connecting rod having a first end pivoted to the first rocker according to a first articulation axis parallel and spaced with respect to the first hinging axis, and a second end pivoted to the second rocker according to a second articulation axis parallel and spaced with respect to the second hinging axis.

In this way, the two rockers and the connecting rod globally achieve an articulated quadrilateral kinematic mechanism which allows a simultaneous and coordinated movement of both electrical contacts from the open configuration to the closed configuration and vice versa.

According to another aspect of the invention, the distance between the first hinging axis and the first articulation axis can be equal (or almost) to the distance between the second hinging axis and the second articulation axis, and the distance between the first articulation axis and the second articulation axis can be equal (or almost) to the distance between the first hinging axis and the second hinging axis.

Thanks to this solution, the kinematic mechanism assumes the configuration of an articulated parallelogram which therefore allows the electrical contacts to be shifted between the open configuration and the closed configuration, always keeping them mutually parallel to each other.

From the constructive point of view, an aspect of the invention provides that the first rocker can comprise a first hole having an axis coinciding with the first articulation axis, that the second rocker can comprise a second hole having an axis coinciding with the second articulation axis, and that the two ends of the connecting rod are curved and fitted respectively inside the first and second holes.

In this way, a very simple and economical solution for achieving the articulated quadrilateral kinematic mechanism is provided.

According to a different aspect of the invention, the first rocker can comprise a pin having an axis coinciding with the first hinging axis and at least a portion with a lobed cross section, which is housed in a seat with conjugate shape with which it achieves a prismatic coupling, said seat being made in a first bracket firmly fixed to the support body and being sufficiently yielding to deform elastically as a result of a rotation of the lobed portion of the pin around the first hinging axis.

Thanks to this solution, the prismatic coupling between the lobed portion of the pin and the relative housing seat advantageously allows to counteract the rotation of the first rocker and therefore of the corresponding electrical contact around the first hinging axis, locking it stably at least in the open configuration and in the closed configuration and possibly in one or more intermediate positions.

At the same time, thanks to the yielding of the bracket, this rotation is not completely excluded but can still be obtained by applying to the electrical contact, that is to the first rocker, a moment of force sufficiently high to allow the lobed portion of the pin to deform the housing seat elastically and to rotate inside it.

To improve this effect, a preferred embodiment provides that the second rocker can in turn comprise a pin having an axis coinciding with the second hinging axis and having at least a portion with a lobed cross section, which is housed in a seat with conjugate shape with which it achieves a prismatic coupling, said seat being made in a second bracket firmly fixed to the support body and sufficiently yielding to deform elastically as a result of a rotation of the lobed portion of the pin around the second hinging axis.

According to a different aspect of the invention, each of the electrical contacts of the electrical plug can have a flat cross section, for example adapted to be coupled to the slots of an electrical socket of the A type or similar.

However, it is not excluded that, in other embodiments, the electrical contacts may have a cylindrical shape, for example adapted to be coupled to the slots of a socket of the C type or similar.

Finally, another embodiment of the present invention makes available an electrical power supply comprising the electrical plug outlined above.

BRIEF DESCRIPTION OF THE DRAWINGS

Further features and advantages of the invention will be more apparent after reading the following description provided by way of non-limiting example, with the aid of the figures shown in the accompanying drawings.

DETAILED DESCRIPTION

Figure 1:
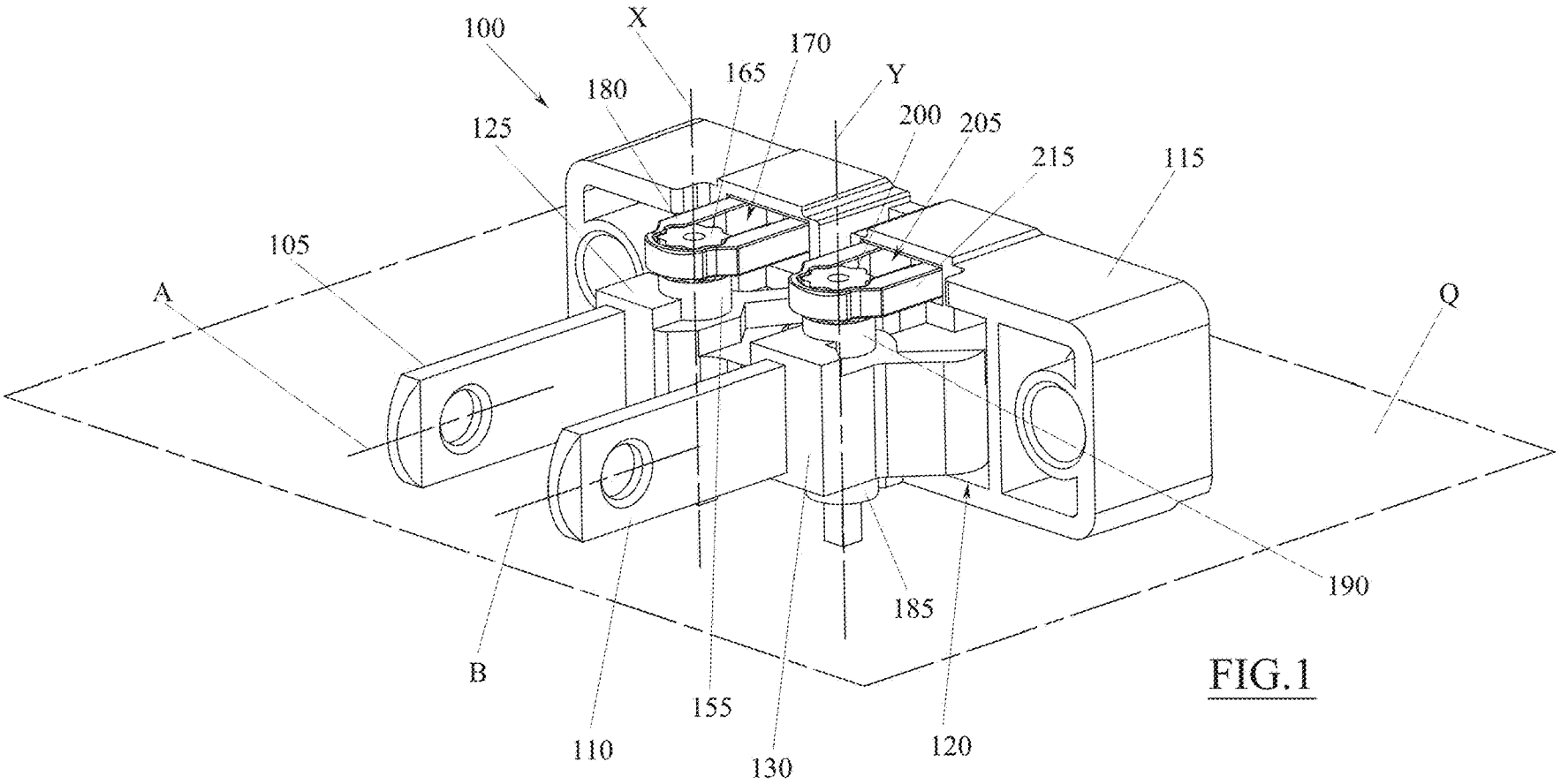
FIG. 1 is an axonometric view of an electrical plug according to an embodiment of the present invention shown in the open configuration.

The figures show an electrical plug 100 adapted to be plugged into a corresponding electrical socket to connect an electrical distribution network, to which the electrical socket is connected, with any electrical/electronic device to be powered/recharged.

The electrical plug first comprises a pair of electrical contacts (prongs), indicated respectively with 105 and 110.

Each of said electrical contacts 105 and 110 is defined/constituted by a solid body of electrically conductive material, for example of brass possibly coated with tin or nickel, which has a generally elongated shape extending mainly along a predetermined longitudinal axis, indicated respectively with A for the electrical contact 105 and with B for the electrical contact 110.

The electrical contacts 105 and 110 are mutually arranged so that the respective longitudinal axes A and B lie coplanar on a common lying plane Q (imaginary).

In the illustrated embodiment, each electrical contact 105 and 110 has a cross section, with respect to the corresponding longitudinal axis A or B, with a flat shape, for example with a substantially rectangular shape, whose longer sides are perpendicular to the lying plane Q.

In this way, the electrical contacts 105 and 110 can be suitable for being inserted in the slots of an electrical socket of the A type or similar.

However, it is not excluded that, in other embodiments, the electrical contacts 105 and 110 may have a cylindrical shape, for example in order to be coupled to a socket of the C type or similar, likewise it is not excluded that the electrical contacts 105 and 110, in the open configuration, have longitudinal axes A and B that are not parallel, but skewed according to a given angle (normally small), even if the axes A and B lie on the same imaginary plane Q.

The electrical plug 100 further comprises a support body 115 which carries the electrical contacts 105 and 110.

This support body 115 can be made of electrically insulating and preferably heat-resistant material, for example in resins and/or other polymeric materials.

In the illustrated example, the support body 115 is shaped like a casing, for example in the shape of a parallelepiped or cuboid having possibly chamfered edges, which has an internal cavity and an opening 120, placed for example at one of its lateral major flanks, adapted to put the internal cavity in communication with the outside.

The support body 115 is connected to the electrical contacts 105 and 110 through connecting members which allow a mutual movement between the electrical contacts 105 and 110 and the support body 115 itself.

In particular, the connecting members comprise two rockers, of which a first rocker 125, to which the electrical contact 105 is firmly fixed overhanging, and a second rocker 130, to which the electrical contact 110 is firmly fixed overhanging.

The first and second rockers 125 and 130 can also be made of electrically insulating and preferably heat-resistant material, for example in resins and/or other polymeric materials.

The first rocker 125 is hinged to the support body 115 according to a first hinging axis X perpendicular to the lying plane Q of the two electrical contacts 105 and 110.

Figure 7:
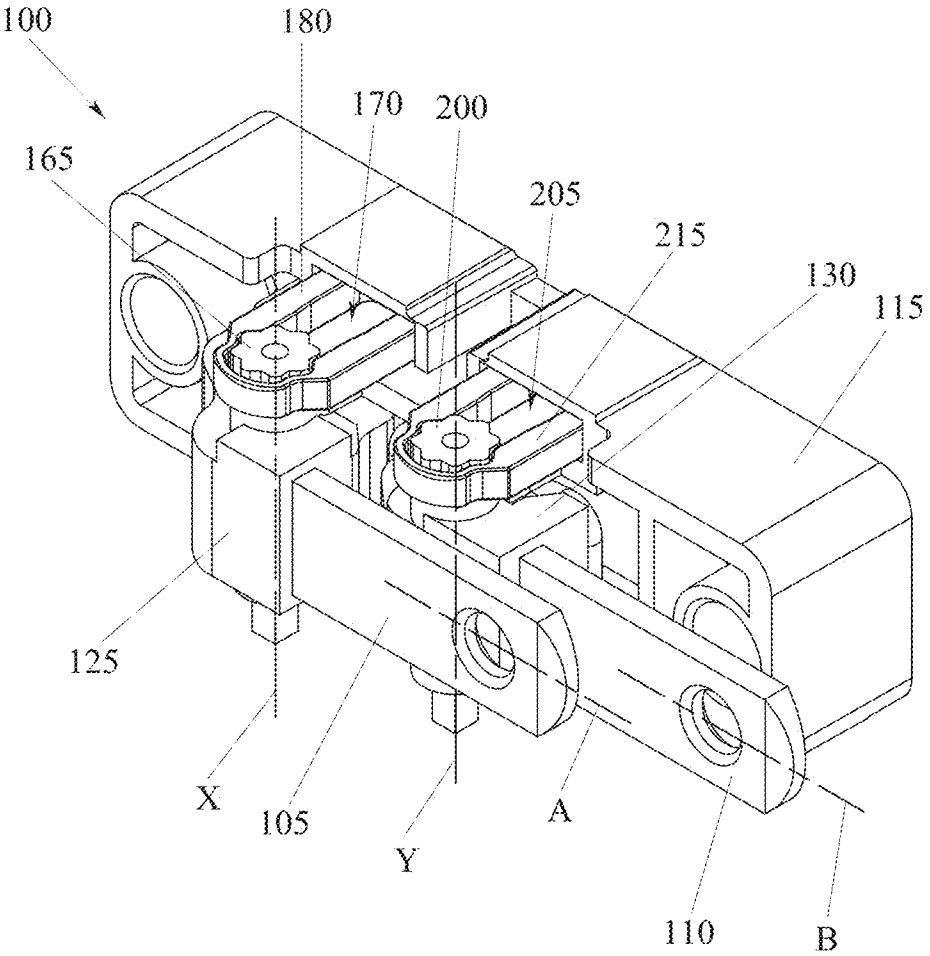
FIG. 7 is an axonometric view of the electrical plug of FIG. 1 shown in closed configuration.

The second rocker 130 is in turn hinged to the support body 115 according to a second hinging axis Y parallel and spaced with respect to the first hinging axis X. In this way, the electrical contacts 105 and 110 can move with respect to the support body, rotating around the hinging axes X and Y of the corresponding rockers 125 and 130, between an open configuration (shown in FIG. 1) and a closed configuration (shown in FIG. 7) and vice versa.

In open configuration, the two electrical contacts 105 and 110 protrude overhanging with respect to the support body 115, with the respective longitudinal axes A and B that are mutually parallel.

For example, the electrical contacts 105 and 110 in open configuration can protrude overhanging with respect to the flank of the support body 115 in which the opening 120 is made and the longitudinal axes A and B can be oriented orthogonally with respect to the same flank.

Figure 4:
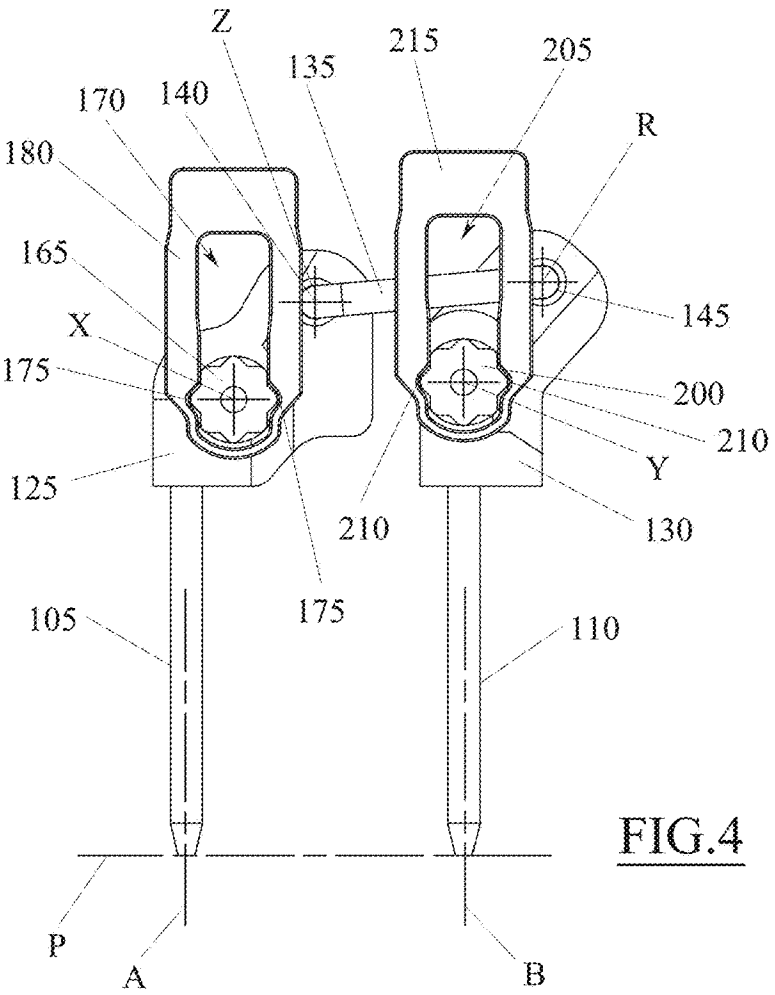
FIG. 4 is a top view of the group of FIG. 4.

As clearly visible in FIG. 4, in said open configuration, the free ends of the electrical contacts 105 and 110 are preferably tangent to a same reference plane P (imaginary) which is orthogonal to the lying plane Q and is also orthogonal to the longitudinal axes A and B.

In this way, the electrical contacts 105 and 110 are perfectly aligned and can be inserted simultaneously in the slots of the corresponding electrical socket (not shown).

When in closed configuration, the electrical contacts 105 and 110 can instead be substantially reclined on each other.

In other words, to switch from the open configuration to the closed configuration, the electrical contacts 105 and 110 can be rotated around the respective hinging axes X and Y in concordant direction, until reaching a flattened configuration in which said electrical contacts 105 and 110 are at least partially superimposed on each other.

Figure 9:
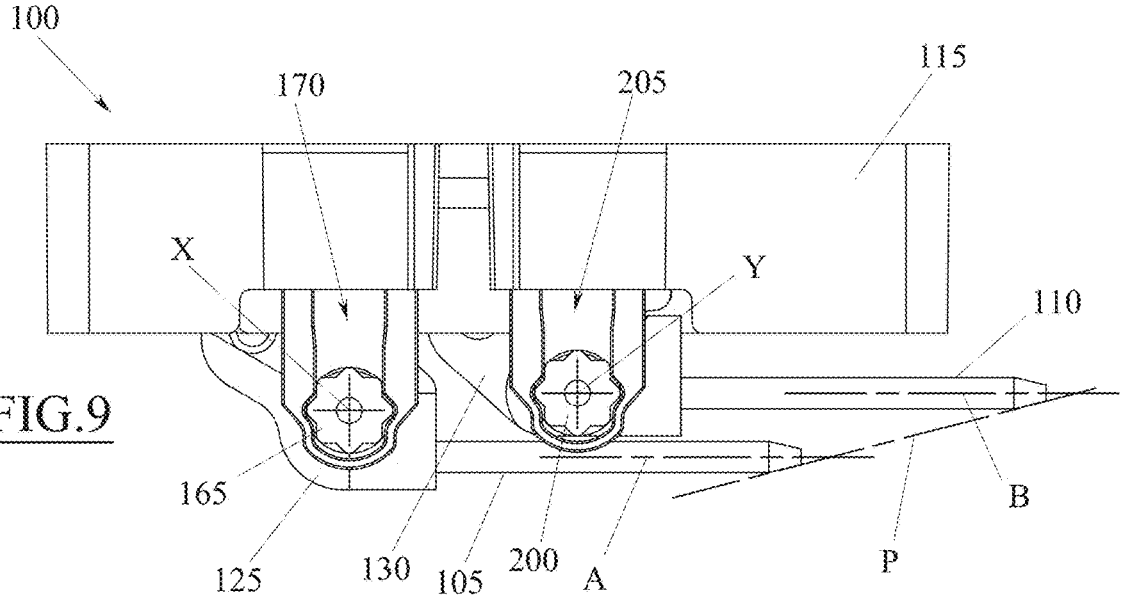
FIG. 9 is a top view of the electrical plug in closed configuration.
Figure 10:
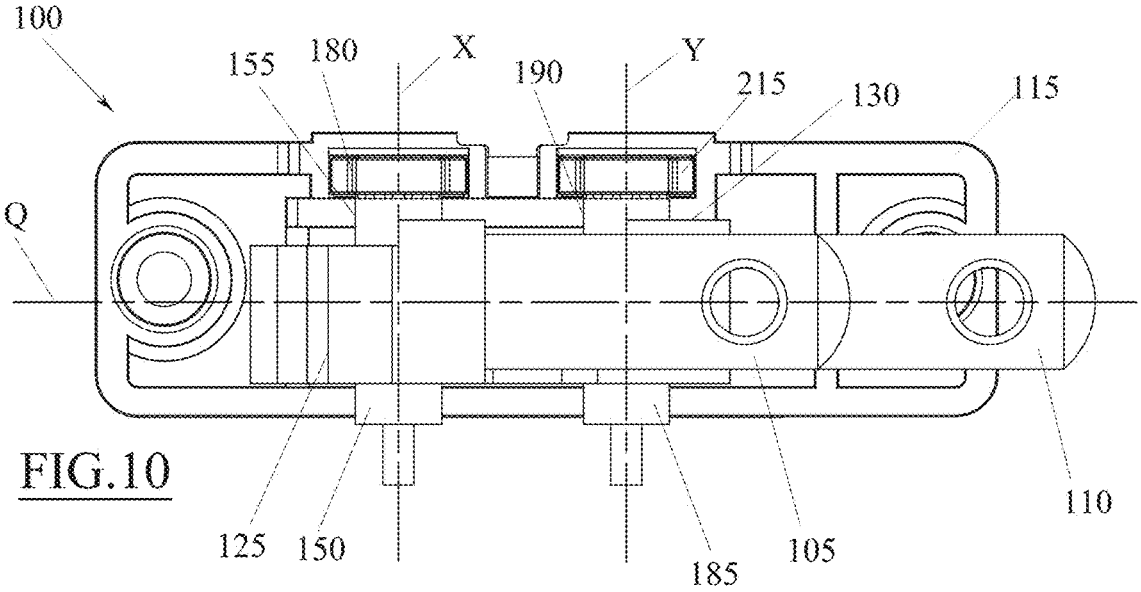
FIG. 10 is a front view of the electrical plug in closed configuration.
Figure 11:
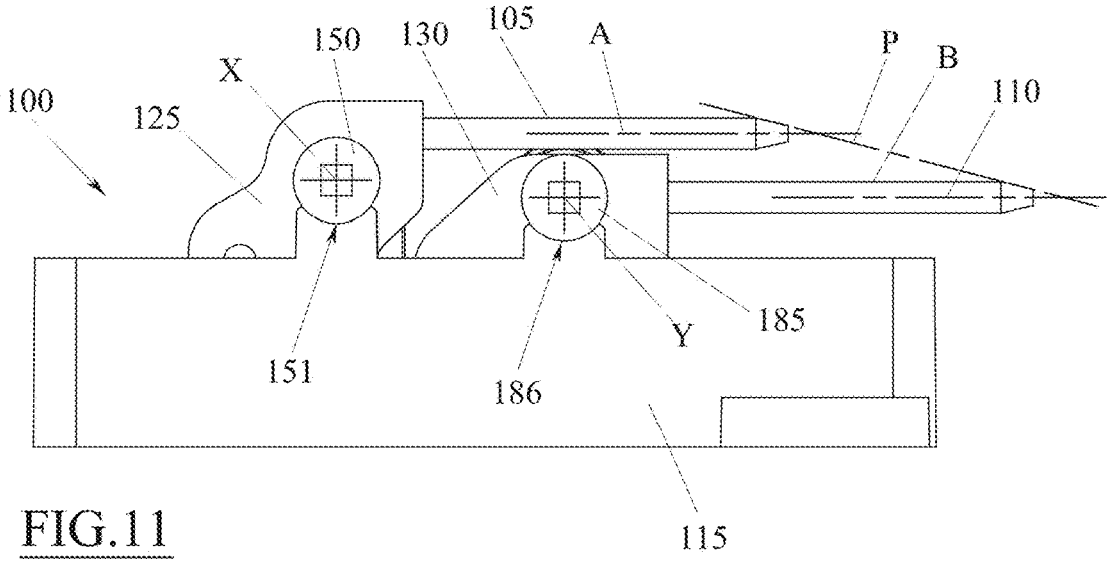
FIG. 11 is a bottom view of the electrical plug in closed configuration.

As clearly visible in FIG. 9, in said closed configuration, the reference plane P (imaginary), orthogonal to the lying plane Q and tangent to the free ends of the electrical contacts 105 and 110 is therefore inclined with respect to the longitudinal axes A and B.

In particular, to switch from the open configuration to the closed configuration, both electrical contacts 105 and 110 can be rotated by an angle equal to about 90°.

In this way, the electrical contacts 105 and 110 in closed position may be oriented so that the respective longitudinal axes A and B are parallel to the flank of the support body 115, from which they protrude overhanging when they are in open configuration.

As illustrated in FIG. 4, to allow said rotation without interference, it is preferable that the distance separating the free end of the first electrical contact 105 and the corresponding first hinging axis X be different, in this case smaller, with respect to the distance between the free end of the second electrical contact 110 and the corresponding second hinging axis Y.

In addition to the two rockers 125 and 130, the connecting members can also comprise a rigid connecting rod 135.

A first end of this connecting rod 135 is pivoted to the first rocker 125 according to a first articulation axis Z parallel and spaced with respect to the first hinging axis X.

A second and opposite end of the connecting rod 135 is pivoted to the second rocker 130 according to a second articulation axis R parallel and spaced with respect to the second hinging axis Y and preferably also spaced with respect to the first articulation axis Z.

In particular, the connecting rod 135 can be shaped like a bar (see FIG. 2), which has a straight central section interposed between two end sections which are folded by about 90°, so as to create a sort of jumper.

Figure 6:
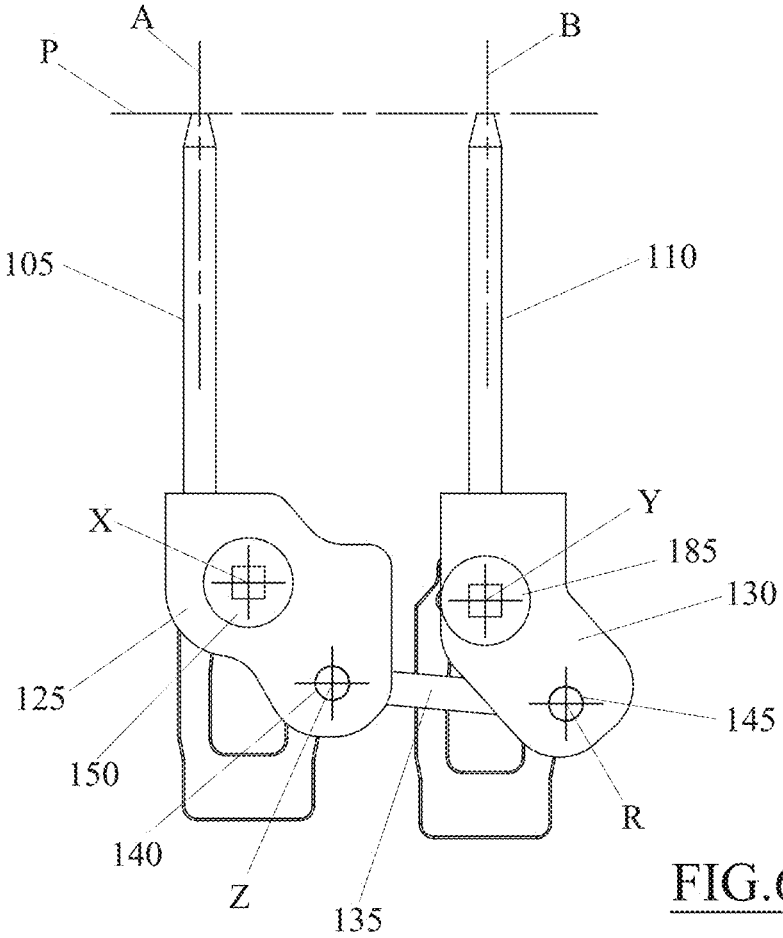
FIG. 6 is a bottom view of the group of FIG. 4.

As illustrated in FIG. 6, one of said curved sections can be coaxially inserted into a hole 140, for example a through hole, made in the first rocker 125 and having an axis coinciding with the first articulation axis Z.

The other curved section can be coaxially inserted in a hole 145, for example a through hole, made in the second rocker 130 and having an axis coinciding with the second articulation axis R.

In this way, the two rockers 125 and 130 and the connecting rod 135 globally achieve an articulated quadrilateral kinematic mechanism which allows a simultaneous and coordinated movement of both electrical contacts 105 and 110 from the open configuration to the closed configuration and vice versa.

In particular, it is preferable that said kinematic mechanism is configured like an articulated parallelogram which therefore allows to shift the electrical contacts 105 and 110 between the open configuration and the closed configuration while keeping the respective longitudinal axes A and B always mutually parallel to each other.

To achieve this effect, the distance between the first hinging axis X and the first articulation axis Z can be equal (or almost) to the distance between the second hinging axis Y and the second articulation axis R, and the distance between the first articulation axis Z and the second articulation axis R can be equal (or almost) to the distance between the first hinging axis X and the second hinging axis Y.

The connecting rod 135 can be made of metallic material, for example steel.

Going into more detail, the first rocker 125 can be hinged to the support body 115 through a pin, which is firmly fixed to the first rocker 125 (for example obtained in a single body therewith), and can extend with an axis coinciding with the first hinging axis X.

Figure 8:
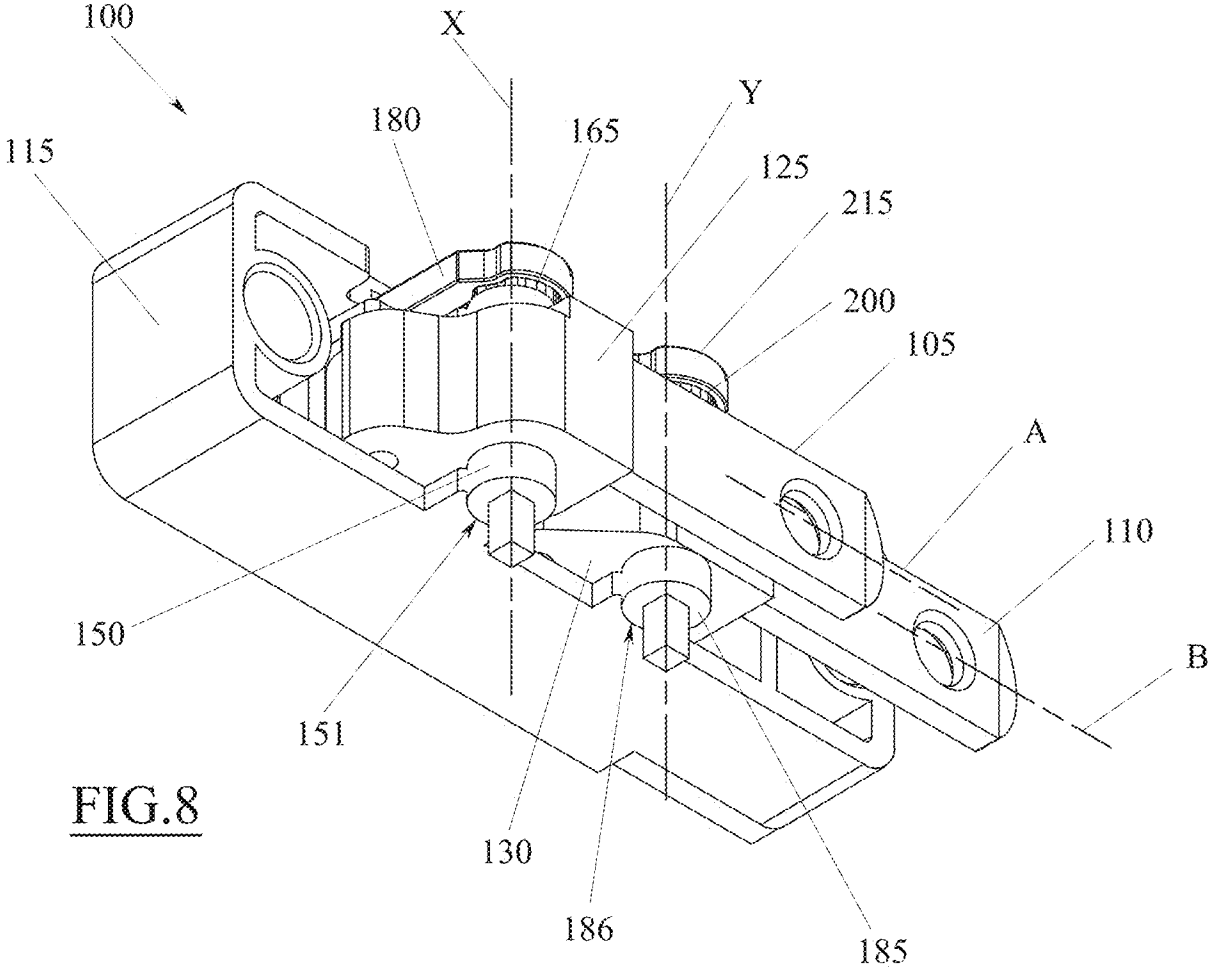
FIG. 8 is another axonometric view of the electrical plug in closed configuration.

In particular, the pin can have a first cylindrical portion 150 (see FIG. 8) protruding from a part of the first rocker 125, for example from the part placed below the lying plane Q, which can be coaxially housed in a corresponding cylindrical seat 151 firmly associated with the support body 115.

In the illustrated example, the cylindrical seat 151 is not a complete cylindrical seat (for example a hole) but is defined by a cylindrical cradle made available at the end of a shelf which protrudes from the support body 115, for example from the lateral flank in which the opening 120 is obtained, and which can be made in a single body with the same.

The pin may further comprise a second cylindrical portion 155 (see FIG. 2) protruding from the part opposite the first rocker 125, for example from the part placed above the lying plane Q, which can be coaxially housed in a corresponding cylindrical seat 156 firmly associated with the support body 115.

Also in this second case, the cylindrical seat 156 is not a complete cylindrical seat but is defined by a cylindrical cradle made available at the end of a shelf which protrudes from the support body 115, for example from the lateral flank in which the opening 120 is obtained, and which can be made in a single body with the same.

Finally, the pin can comprise a further portion 165 which can be coaxial and adjacent to the second cylindrical portion 155.

Figure 2:
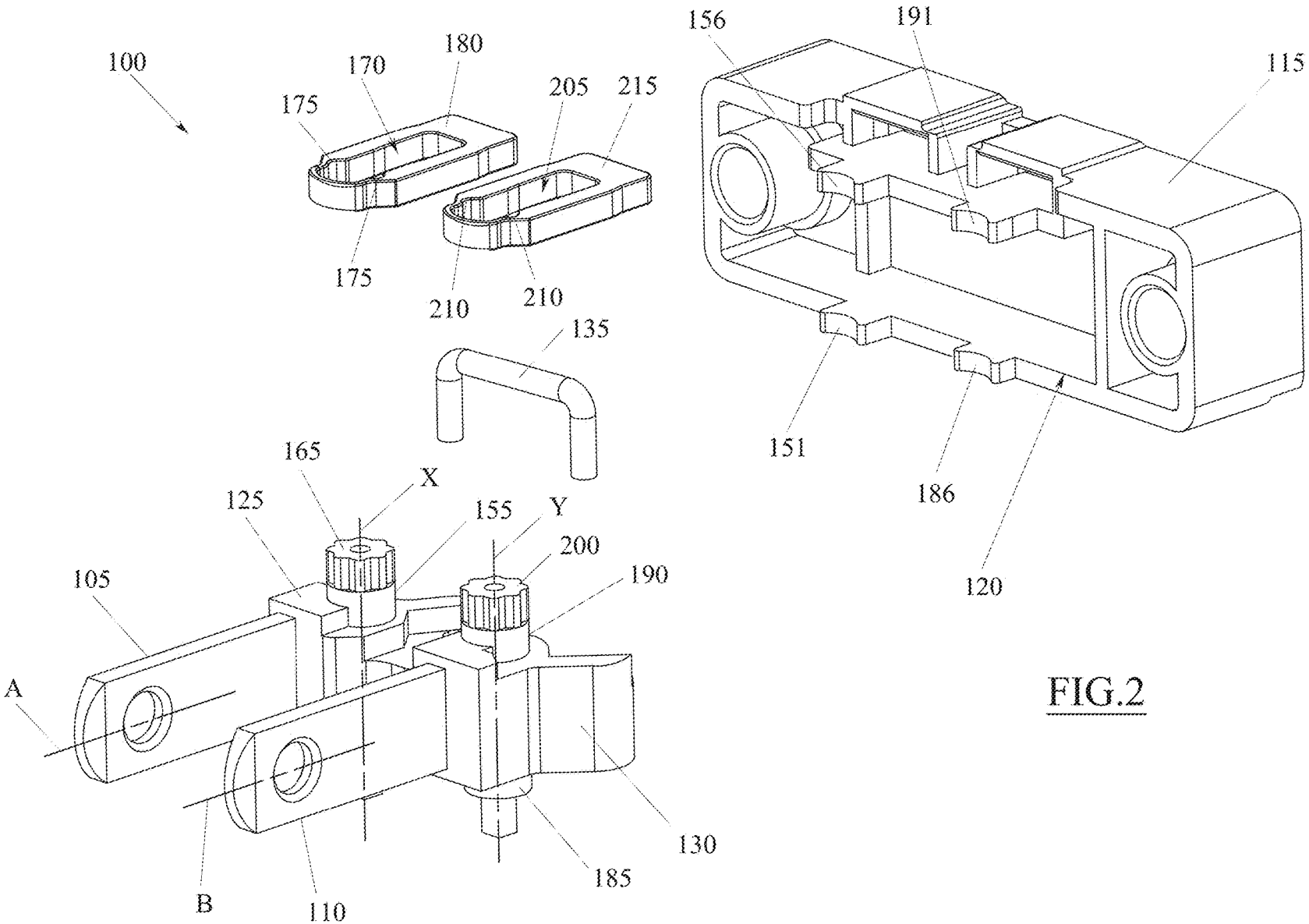
FIG. 2 is an exploded view of the electrical plug of FIG. 1.

However, this further portion 165 is not cylindrical but can have a lobed or grooved cross section (i.e. made with respect to a plane orthogonal to the axis of the pin) (see also FIG. 2).

In the illustrated example, the cross section of the portion 165 has a plurality of lobes (in this case 8), which are angularly equidistant between them and are preferably connected to each other through sinuous and continuous profiles.

Figure 3:
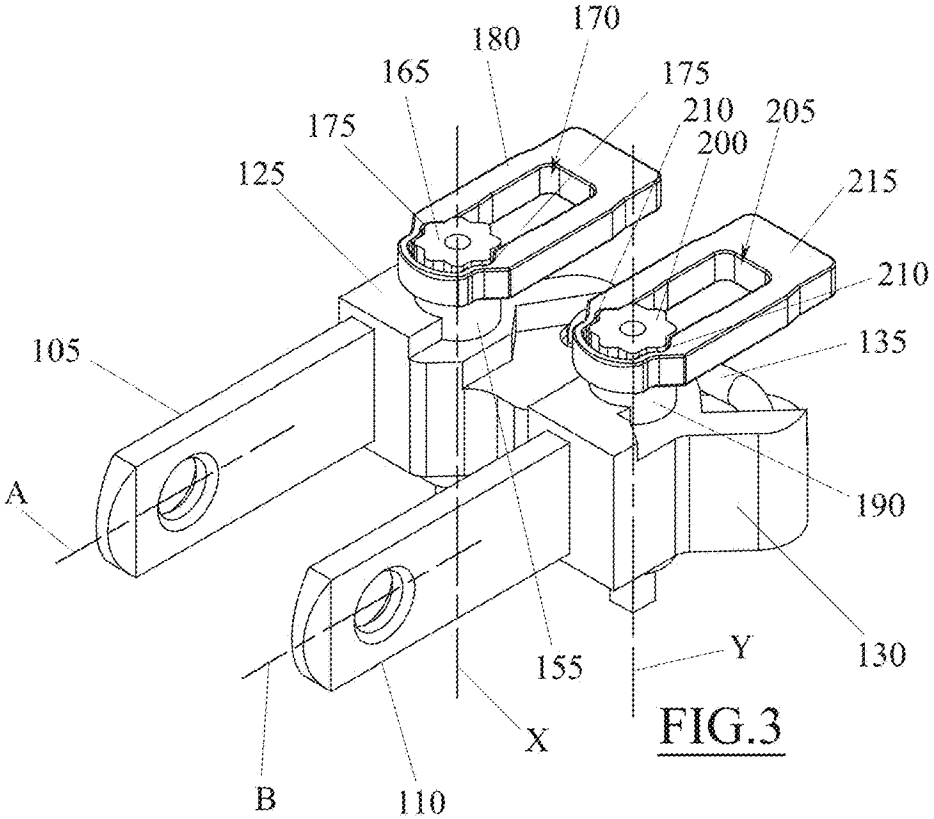
FIG. 3 is an axonometric view of the electrical plug of FIG. 1 shown without the support body.
Figure 5:
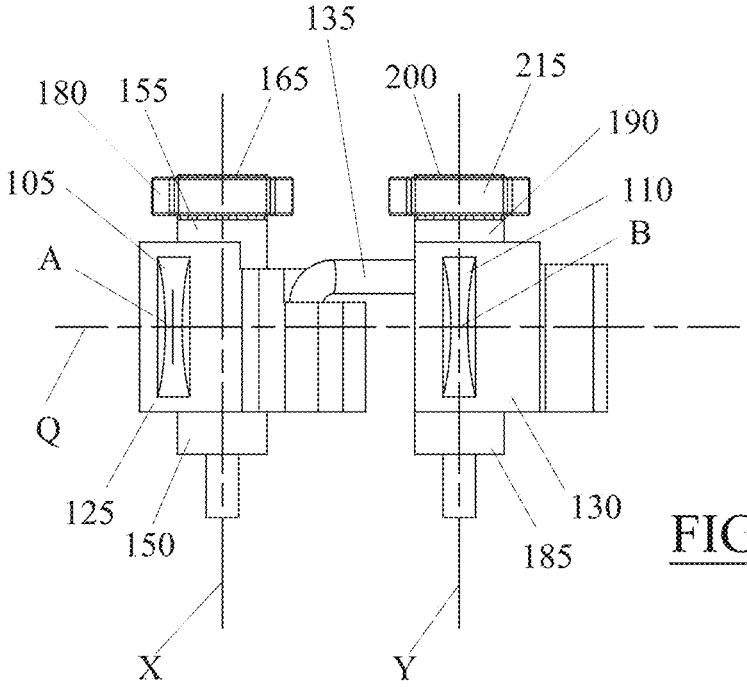
FIG. 5 is a front view of the group of FIG. 4.

As illustrated for example in FIG. 3, said lobed portion 165 of the pin can be housed in a seat 170 with at least partially conjugate shape with which it is able to achieve a prismatic coupling, i.e. capable of opposing the free rotation of the pin around the first hinging axis X.

In the illustrated example, said housing seat 170 has the shape of a slot having a smaller width than the external diameter of the lobed portion 165 but provided with two mutually opposed recesses 175, which are adapted to house, substantially to size, two diametrically opposed lobes of the lobed portion 165.

Going into more detail, the housing seat 170 can be made in a bracket 180, which is firmly fixed to the support body 115 and can protrude overhanging from the same, for example from the flank where the opening 120 is obtained.

This bracket 180 can be made as a separate component, for example in plastic, which is coupled and fixed to the support body 115 by interlock or by any other known means.

In this way, the prismatic coupling between the lobed portion 165 of the pin and the relative housing seat 170 advantageously allows to counteract the rotation of the first rocker 125 and therefore of the corresponding electrical contact 105 around the first hinging axis X, stopping it stably at least in the open configuration and in the closed configuration and possibly in one or more intermediate positions, that is avoiding that it can move from these positions due to the effect of gravity, small impacts or other little external stresses.

The bracket 180 is however made (for example as regards its sizing and the material of which it is made) in such a way as to be sufficient yielding so that, if the first rocker 125 is actively forced to rotate around the first hinging axis X, the lobes of the lobed portion 165 of the pin can elastically deform the housing seat 170.

In this way, the rotation of the first rocker 125 between the open configuration and the closed configuration is not excluded but can be advantageously obtained by applying a sufficiently high moment of force to allow the lobed portion 165 to deform elastically the housing seat 170 and to rotate inside it.

For example, this moment of force can be applied manually, by acting on the corresponding electrical contact 105 or on any other component of the kinematic chain.

The same coupling system described for the first rocker 125 is preferably also used for the second rocker 130.

In particular, with reference again to FIG. 8, the second rocker 130 can be hinged to the support body 115 through a pin, which is firmly fixed to the second rocker 130 (for example obtained in a single body therewith) and extends with an axis coinciding with the second hinging axis Y.

The pin can have a first cylindrical portion 185 which protrudes from a part of the second rocker 130, for example from the part placed below the lying plane Q, which can be coaxially housed in a corresponding cylindrical seat 186 firmly associated with the support body 115.

In the illustrated example, the cylindrical seat 186 is not a complete cylindrical seat (for example a hole) but is defined by a cylindrical cradle made available at the end of a shelf which protrudes from the support body 115, for example from the lateral flank in which the opening 120 is obtained, and which can be made in a single body with the same.

The pin may further comprise a second cylindrical portion 190 (see FIG. 2) protruding from the part opposite the first rocker 125, for example from the part placed above the lying plane Q, which can be coaxially housed in a corresponding cylindrical seat 191 firmly associated with the support body 115.

Also in this second case, the cylindrical seat 191 is not a complete cylindrical seat but is defined by a cylindrical cradle made available at the end of a shelf which protrudes from the support body 115, for example from the lateral flank in which the opening 120 is obtained, and which can be made in a single body with the same.

Finally, the pin can comprise a further portion 200 which can be coaxial and adjacent to the second portion 190.

However, this further portion 200 is not cylindrical but has a lobed cross section (i.e. made with respect to a plane orthogonal to the axis of the pin).

In particular, the cross section of the lobed portion 200 also has a plurality of lobes (in this case 8), which are angularly equidistant between them and are preferably connected to each other through sinuous and continuous profiles.

As illustrated in FIG. 3, this lobed portion 200 can be housed in a seat 205 with at least partially conjugate shape, with which it is able to achieve a prismatic coupling, i.e. capable of opposing the rotation of the pin around the second hinging axis Y.

In the illustrated example, this seat 205 has the shape of a slot having a width smaller than the external diameter of the lobed portion 200 but provided with its mutually opposed recesses 210, which are adapted to house, substantially to size, two diametrically opposed lobes of the lobed portion 200.

The seat 205 can be made in a bracket 215, which is firmly fixed to the support body 115 and can protrude overhanging from the same, for example from the flank in which the opening 120 is obtained.

This bracket 215 can be made as a separate component, for example in plastic, which is coupled and fixed to the support body 115 by interlock or by any other known means.

In this way, the prismatic coupling between the lobed portion 200 and the corresponding housing seat 205 advantageously allows to counteract the rotation of the second rocker 130 and therefore of the corresponding electrical contact 110 around the second hinging axis Y, locking it stably at least in the open configuration and in the closed configuration and possibly in one or more intermediate positions, that is avoiding that it can move from these positions due to the effect of gravity, small impacts or other minor external stresses.

The bracket 215 is however made (for example as regards its sizing and the material of which it is made) so as to be sufficiently yielding so that, if the second rocker 130 is actively forced to rotate around the second hinging axis Y, the lobes of the lobed portion 200 of the pin can elastically deform the housing seat 205.

In this way, the rotation of the second rocker 130 between the open configuration and the closed configuration is not excluded but can be advantageously obtained by applying a sufficiently high moment of force to allow the lobed portion 200 to elastically deform the housing seat 205 and rotate inside it.

For example, this moment of force can be applied manually, by acting on the corresponding electrical contact 110 or on any other component of the kinematic chain.

Figure 13:
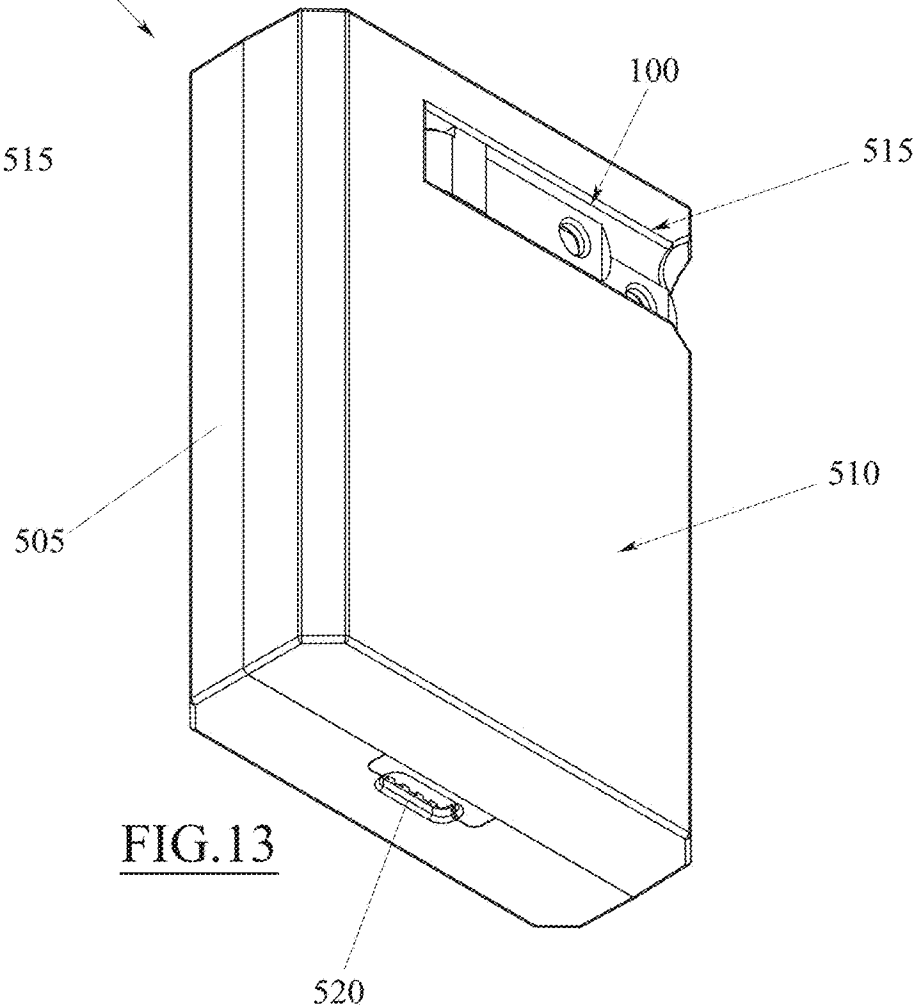
FIG. 13 is an axonometric view of the electrical power supply of FIG. 12 with the electrical plug in closed configuration.
Figure 12:
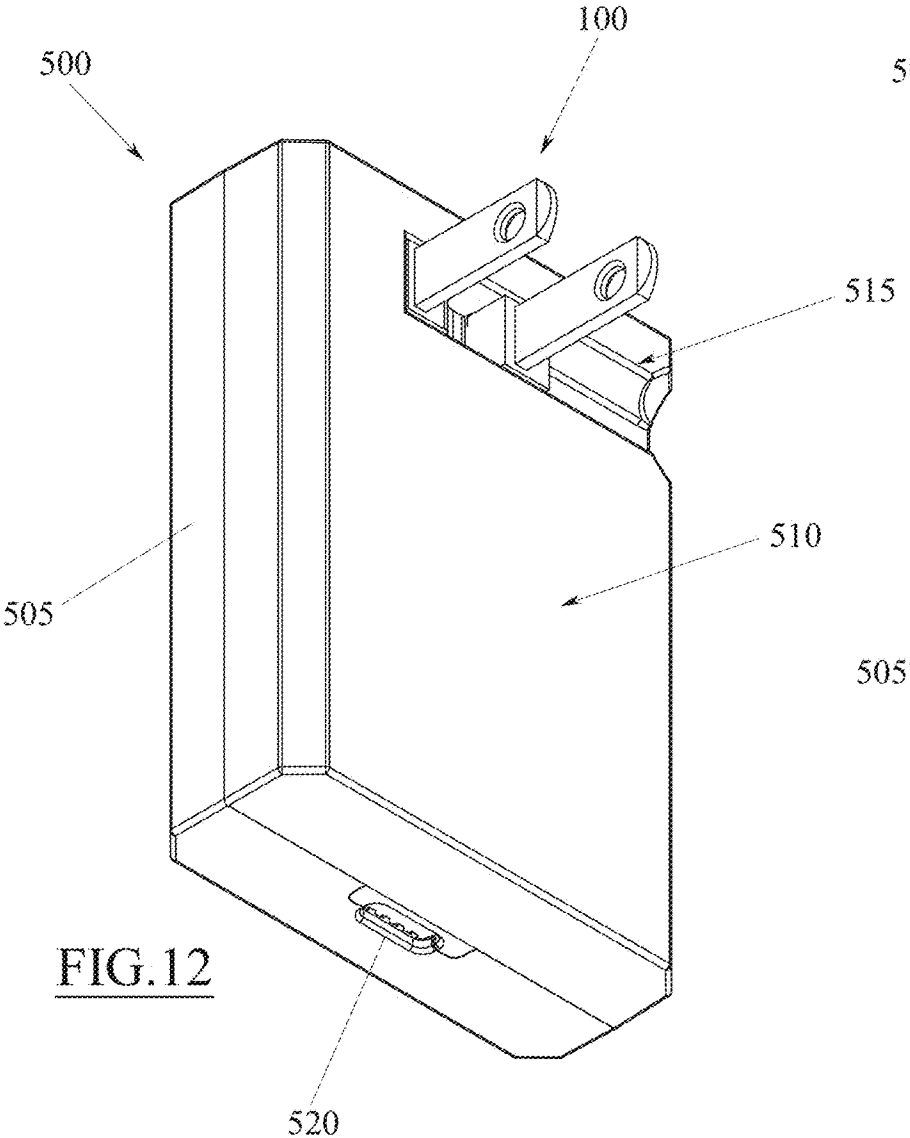
FIG. 12 is an axonometric view of an electrical power supply provided with the electrical plug of FIG. 1 in open configuration.

As illustrated in FIGS. 12 and 13, a possible but not exclusive use of the electrical plug 100 described above is to be installed on an electrical power supply 500 for electrical/electronic devices, such as for example laptop computers, tablet computers, smartphones and much more.

The electrical power supply 500 comprises an external casing 505, which can have a flat surface 510 in which a housing seat 515 for the electrical plug 100 is obtained.

In particular, the housing seat 515 can be sized so as to entirely contain the support body 115, which can be fixed by means of screws or any other conventional system.

The housing seat 515 can also provide sufficient space to completely contain also the electrical contacts 105 and 110 when they are in closed configuration (see FIG. 13).

In open configuration, the electrical contacts 105 and 110 instead protrude from the housing seat 515, projecting orthogonally overhanging beyond the flat surface 510, so that they can be coupled to the corresponding electrical socket of a distribution network.

An external output port 520, for example micro-USB type, Type-C USB or any other type, can be installed on the external casing 505 for the connection via cable of the power supply 500 to the device to be powered.

Inside the external casing 505, the power supply 500 can finally comprise the circuitry necessary to convert the alternating voltage received at the input through the electrical plug 100 into a suitable direct voltage which is transmitted to the device to be powered through the output port 520.

Obviously, an expert in the field may make several technical-applicative modifications described above, without departing from the scope of the invention as hereinbelow claimed.

The invention claimed is:

1. An electrical plug comprising:

a support body, a pair of electrical contacts of elongated shape having respective longitudinal axes arranged coplanar on a common lying plane, and connecting members adapted to allow a mutual movement between said electrical contacts and the support body, wherein said connecting members comprise:

a first rocker hinged to the support body according to a first hinging axis perpendicular to the lying plane, and a second rocker hinged to the support body according to a second hinging axis parallel and spaced with respect to the first hinging axis, each electrical contact being fixed overhanging a respective of said first and second rockers, wherein the first rocker comprises a pin having an axis coinciding with the first hinging axis and at least a portion with a lobed cross section, which is housed in a seat with conjugate shape with which the pin achieves a prismatic coupling, said seat being made in a first bracket firmly fixed to the support body and being sufficiently yielding to deform elastically as a result a rotation of the lobed portion of the pin around the first hinging axis.

2. The electrical plug according to claim 1, wherein the connecting members further comprise:

a connecting rod having a first end pivoted to the first rocker according to a first articulation axis parallel and spaced with respect to the first hinging axis, and a second end pivoted to the second rocker according to a second articulation axis parallel and spaced with respect to the second hinging axis.

3. The electrical plug according to claim 2, wherein a distance between the first hinging axis and the first articulation axis is equal to a distance between the second hinging axis and the second articulation axis, and wherein a distance between the first articulation axis and the second articulation axis is equal to a distance between the first hinging axis and the second hinging axis.

4. The electrical plug according to claim 2, wherein the first rocker comprises a first hole having an axis coinciding with the first articulation axis, wherein the second rocker comprises a second hole having an axis coinciding with the second articulation axis, and wherein the two ends of the connecting rod are curved and fitted respectively inside the first and second holes.

5. The electrical plug according to claim 1, wherein the second rocker comprises a pin having an axis coinciding with the second hinging axis and having at least a portion with lobed cross section, which is housed in a conjugate shaped seat with which the pin achieves a prismatic coupling, said seat being made in a second bracket firmly fixed to the support body and sufficiently yielding to deform elastically as a result of a rotation of the lobed portion of the pin around the second hinging axis.

6. The electrical plug according to claim 1, wherein each of the electric contacts has a flat cross section.

7. An electrical power supply comprising the electrical plug according to claim 1.

* * * * *